United States Patent [19]

Melcher

[11] 4,414,022

[45] Nov. 8, 1983

[54] METHOD AND APPARATUS FOR SMELTING SULFIDIC ORE CONCENTRATES

[75] Inventor: Gerhard Melcher, Cologne, Fed. Rep. of Germany

[73] Assignee: Klöckner-Humboldt-Deutz AG, Fed. Rep. of Germany

[21] Appl. No.: 340,300

[22] Filed: Jan. 18, 1982

[30] Foreign Application Priority Data

Jan. 17, 1981 [DE] Fed. Rep. of Germany ..... 3101369

[51] Int. Cl.[3] ..... C22B 5/16

[52] U.S. Cl. ..... 75/26; 75/74; 75/92; 266/156; 266/182; 266/190

[58] Field of Search ..... 75/73, 74, 26, 92; 266/182, 190, 156

[56] References Cited

U.S. PATENT DOCUMENTS 2,688,478 9/1954 Lykken ..... 266/182
3,554,515 1/1971 Torooka et al. ..... 266/156
3,849,120 11/1974 Norman ..... 75/74
4,027,863 6/1977 Aaltunen et al. ..... 266/190

*Primary Examiner*—M. J. Andrews
*Attorney, Agent, or Firm*—Hill, Van Santen, Steadman & Simpson

[57] ABSTRACT

Method and apparatus for smelting a sulfidic ore concentrate such as a copper concentrate in which the concentrate is smelted in an oxidizing atmosphere, the melt is after-treated with reducing gases from a plurality of lances which blow the reducing gases onto the melt in the form of concentrated streams of high kinetic energy and form a metal-rich phase and a slag phase. The improvement of the present invention is concerned with oxidizing the concentrate sufficiently to form an enriched metal matte containing more than 75% by weight metal at a throughput of more than 500 metric tons per day, the oxidizing being carried out in a smelting cyclone operating as a steam generator and at a sufficiently high temperature so that the heat transferred to the cyclone walls is at least 500,000 Kcal/sq. m. of cyclone wall/hr.

7 Claims, 1 Drawing Figure

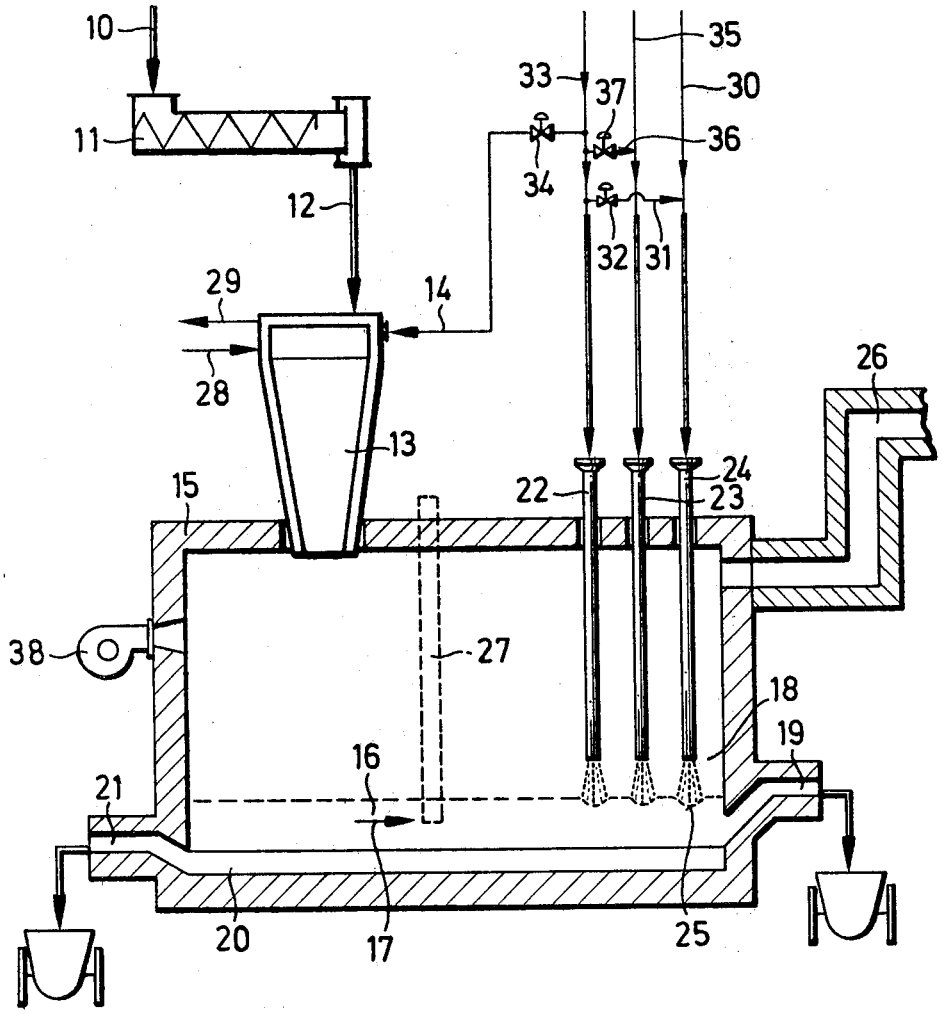
10
11
12
13
14
15
16
17
18
19
20
21
22
23
24
25
26
27
28
29
30
31
32
33
34
35
36
37
38

METHOD AND APPARATUS FOR SMELTING SULFIDIC ORE CONCENTRATES

CROSS-REFERENCE TO RELATED APPLICATIONS

This application has subject matter in common with prior U.S. applications Ser. Nos. 152,592, filed May 23, 1980 and 290,077, filed Aug. 4, 1981, both of said prior applications being assigned to the same assignee as this application.

BACKGROUND OF THE INVENTION

1. Field of the Invention

This invention is in the field of smelting sulfidic ores utilizing a smelting cyclone to produce an enriched metal matte and a basic slag, the metal and slag being further treated by means of a plurality of lances which blow reducing gases onto the melt to form a metal-rich phase and a slag phase which is very low in the desired metal.

2. Description of the Prior Art

The treatment of fine-grained sulfidic ore concentrates by melting in an oxidizing atmosphere, and after-treating the melt by means of blowing reducing gases thereon through a plurality of lances in the form of focused streams with high kinetic energy was described initially in German AS No. 29 22 189.

Until now, only as much sulfur was oxidized into sulfur dioxide in the oxidizing atmosphere of the smelting reactor as to produce a molten metal matte phase containing approximately 40 to 50% by weight of the metal to be recovered. In the case of sulfidic copper ore concentrate, the slag phase was converted by means of reduction into a copper-depleted slag of approximately 0.35% copper which could then be directly settled. The metal matte, for example, copper matte, must then be converted in a converter to blister copper. In the flash smelting method, the processing of sulfidic ore concentrate into a metal-enriched metal matte is beset with problems because in order to achieve the metal-enriched matte in the flash smelting reactor, more sulfide must be burned into sulfur dioxide with the result that the increasing amount of heat can no longer be diverted out of the reactor. Thus, the production of a high-grade metal matte containing, for example, 80% of the valuable metal content is only possible in a conventional, large smelting furnace. The use of a flash smelting method in combination with a flash smelting stack has only been previously proposed in references such as German AS No. 25 36 392. In that disclosure, a flash smelting stack having a capacity of only about 0.5 through 3 metric tons per hour was used, and that size is not suitable for industrial use.

A flash smelting stack with a height of a few meters provides additional furnace wall surfaces through which the heat of oxidation could be discharged. In a smelting cyclone with the same throughput power having a small volume in comparison thereto, the cooled wall surface area available is reduced to approximately one-tenth, that is, the specific thermal transmission coefficient is at least 10 times higher in the smelting cyclone than in the smelting stack. Therefore, it was not possible previously, by employing a smelting cyclone for melting sulfidic ore concentrate to produce a metal matte phase which exhibited a higher metal content than approximately 50%. The copper matte containing 72% copper achieved in the numerical example of German AS No. 29 22 189 relates to a smelting cyclone having a throughput which was not on an industrial scale.

A further difficulty in producing a metal matte phase with a high valuable metal content of, for example, 80% arises from the fact that the metal content in the slag increases noticeably at the same time so that the slag cannot readily be treated to recover the dissolved metal.

It is not feasible to enlarge a smelting cyclone at random in order to create larger cooled wall surfaces. This is because the cyclone eddy currents cannot be provided with the required high velocity and the danger exists that particles of ore concentrate will fall to the bottom of the cyclone unsmelted.

SUMMARY OF THE INVENTION

The present invention seeks to improve the method and apparatus of German AS No. 29 22 189 in such a manner that in processing sulfidic ore concentrates using a smelting cyclone, a metal matte phase with a very high valuable metal content can be smelted under industrial conditions and a slag depleted in metal can be directly settled in a single stage without further after-treatment being necessary.

The smelting cyclone of the present invention is characterized by a very high power density and an extremely fast reaction sequence. The sulfidic ore concentrate can be treated in a comparatively small volume smelting cyclone. A great deal of sulfide sulfur is burned into sulfur dioxide creating an extremely large amount of heat which becomes greater as the sulfide sulfur is more completely burned, and as the metal phase becomes richer in the desired metal content. With a desired high throughput of more than 500 metric tons of sulfidic ore concentrate per day in a smelting cyclone, a high-grade fine matte or white metal containing over 75% of the desired metal content can be smelted with the present invention. In order to dissipate the extremely high amount of heat being released, the smelting cyclone of the present invention is operated as a steam generator to take advantage of the heat of vaporization which is constantly withdrawn from the smelting reactor. The high-grade fine matte or white metal can be readily converted into pure raw metal with a comparatively slight outlay. Only a correspondingly small amount of secondary slag is thus produced in a small converter following the reactor of the present invention. The primary slag having a metal content which is relatively high and which arises as a result of the production of the high-grade matte is treated by means of reducing reaction gases at conditions of high kinetic energy and is so largely depleted of valuable metal (containing less than 0.5% metal in the slag) that the slag can be directly settled and the usual slag cleaning stage following the reactor is eliminated.

The apparatus for treating sulfidic ore concentrates according to the present invention includes a furnace housing, a smelting cyclone which discharges into the furnace housing, and a plurality of spaced lances in the housing which are arranged to blow reducing gases onto the surface of the molten metal formed in the smelting cyclone. The smelting cyclone is also provided with a water inlet line which circulates water therethrough, and a steam exit line for removing steam generated by passage of water through the smelting cyclone.

BRIEF DESCRIPTION OF THE DRAWINGS

The single FIGURE of the drawings illustrates schematically an embodiment of the present invention employing a pyrometallurgical furnace system for treating fine-grained sulfidic copper ore.

DESCRIPTION OF THE PREFERRED EMBODIMENTS

Referring to the attached FIGURE, the copper ore concentrate is delivered through an inlet line 10 together with additives to a conveyor 11 from which the product is supplied by means of a conduit 12 to a smelting cyclone 13. A stream 14 of technically pure oxygen is blown in tangentially of the smelting cyclone 13. While the feed material is still in suspension or in an eddy state, it is roasted and melted in the smelting cyclone 13 and the smelt is delivered by gravity into a furnace housing 15. The smelting cyclone is such that the material is instantaneously heated to high temperatures within fractions of a second. The burning of the sulfur and other oxidizable components in the oxygen atmosphere usually supplies sufficient heat in order to permit the roasting and smelting operation to proceed autogenously, particularly when almost the entire sulfide sulfur content is burned in order to achieve a high-grade fine matte or white metal. It should be understood that in addition to sulfidic copper ore concentrates, other non-ferrous metal-containing ores or concentrates as well as residues or slags of metallurgical processes can be processed in the pyrometallurgical furnace system to produce metal-enriched products.

Below the smelting cyclone 13, a melt 16 collects in the furnace housing 15, the melt 16 flowing in the direction of the arrow 17 into a refining means which is likewise disposed in the furnace housing 15 and in which the melt is after-treated. An overflow weir 19 is disposed adjacent the top blowing means 18 for discharging slag, and the heavier metal-containing phase 20 is withdrawn through a discharge line 21 at the opposite side of the housing, the level of the discharge opening 21 being lower than the slag overflow weir 19.

The top-blowing means 18 includes a plurality of rows of spaced, essentially vertical top-blowing lances 22, 23, and 24 through which a reducing gas is passed in the form of a concentrated stream of high kinetic energy to the phase boundary layer between the slag and the melt. The lances are preferably adjustable in height in order to be able to precisely set the optimum blowing impression 25 on the surface of the metal bath.

As explained in co-pending application Ser. No. 290,077 the spacing between the rows of lances is correlated with the spacing between the individual lances in a row so as to produce highly turbulent, toroidal reaction zones immediately beneath each lance, which zones are separated from similar reaction zones in the next row of lances by a relatively quiescent liquid zone which prevents reverse mixing of slag constituents into the metal being refined in a previous row of lances. Each row of lances thus provides a separate reaction system, and the smelt slowly flowing under the lances is continuously reduced in a step-by-step reaction when the lances are fed with reduction gases having reduction potentials which increase from one row of lances to the next.

Along with the dust and metal vapors formed, exhaust gas is withdrawn by means of an exhaust gas line 26 and passes to a gas cleaning system (not shown) and to a condenser for the precipitation of metal vapors and, if necessary, to a waste heat recuperator for the combustion of remaining, combustible gas components of the exhaust gas.

A partition 27 may be included to separate the oxidizing atmosphere in the melting portion from the reducing atmosphere in the refining portion of the furnace system. The partition 27 is immersed into the melt 16 in the furnace housing 15 between the smelting reactor 13 and the rows of top-blowing lances 22, 23 and 24. When such a partition is used, the smelting portion of the furnace system 15 must be equipped with its own exhaust gas line.

The combustion of the sulfide sulfur in the smelting cyclone 13 is carried out in accordance with the present invention so that the specifically heavier, metal-containing phase 20 is a high-grade copper matte with more than 75% copper. The extremely high amount of heat generated in the smelting cyclone 13 provides a high throughput power of more than 500 metric tons of ore concentrate per day. The heat is continuously removed by making the smelting cyclone 13 a steam generator, provided with a feed line 28 for boiler feed water and a steam exit line 29 for removing the generated steam. Steam produced can be employed as process steam or for operating a turbine. The outlet melt temperature from the high output smelting cyclone which also operates as a steam generator is at least 1600° C. and is preferably about 1800° C. A basic slag is produced containing more than 60% FeO and has a melting point of greater than 1250° C. The slag has a low solubility for copper.

The smelting cyclone 13 is kept sufficiently small so that the heat transfer to the cyclone walls is at least 500,000 Kcal/sq.m. of cyclone wall/hr.

When the partition 27 is used, means are provided for water-cooling the same. The top-blowing rows of lances 22, 23 and 24 which are disposed at approximately equal spacings in the longitudinal direction of the furnace housing are likewise water-cooled.

To provide a precise setting for the reduction potential of the gases, a gaseous hydrocarbon such as propane is introduced through an inlet line 30 and mixed with less than stoichiometric proportions with oxygen which is obtained from a principal oxygen line 33 through a branch line 31 and a valve 32. An oxygen feed line 14 is also branched off to the smelting cyclone 13 by means of a valve 34.

A combustible gas is introduced through a line 35 and is blown onto the melt 16 through one or more lances 23, the combustible gas being caused to burn at the point where it strikes the hot surface of the melt bath so that an optimum heat transfer to the melt bath is achieved. With the endothermic reduction processes involved, the desired reduction temperature for the melt can be precisely controlled and the desired volatilization reactions can be allowed to occur. When the atmosphere in the top-blowing device no longer contains sufficient oxygen in the area of the discharge nozzle of the lance 23 for the purpose of burning the combustible gas, then air or oxygen is mixed with the combustible gas by means of a branch line 36 and valve 37 from the principal oxygen line 33. However, it is also possible to dispose a burner 38 which supplies heating gas to cover the thermal losses through a wall of the furnace housing 15. Oxidation gases can also be blown onto the melt 16 through the lance 22 so that the lance 22 is simply connected to the principal oxygen line 33. In this case, the residual sulfide sulfur which has not been converted into sulfur dioxide in the smelting cyclone 13 as well as other components which are still oxidizable can be after-oxidized in the melt bath. It should also be realized that a flash-smelting stack can be employed instead of the smelting cyclone 13.

It should also be evident that various modifications can be made to the described embodiments without departing from the scope of the present invention.

I claim as my invention:

1. In a method of smelting a sulfidic ore concentrate or the like in which said concentrate is melted in an oxidizing atmosphere, the melt is after-treated with reducing gases from a plurality of lances which blow said reducing gases onto said melt in the form of concentrated streams of high kinetic energy, to produce a metal-rich phase and a slag phase, the improvement which comprises:

oxidizing said concentrate sufficiently to form an enriched metal matte containing more than 75% by weight metal at a rate of more than 500 metric tons/day, said oxidizing being carried out in a smelting cyclone having a melt outlet temperature of at least 1600° C., circulating feed water through said smelting cyclone to generate steam, and recovering the steam thus produced.

2. A method according to claim 1 in which said ore concentrate is a sulfidic copper concentrate.

3. A method according to claim 1 in which:

said smelting cyclone has a temperature at its melt outlet of approximately 1800° C.

4. A method according to claim 1 in which:

said smelting cyclone is sufficiently small so that the heat transfer to the cyclone walls is at least 500,000 Kcal/sq.m. of cyclone wall/hr.

5. A method according to claim 1 in which said slag phase contains more than 60% FeO, has a melting point in excess of 1250° C., and has a low solubility for copper.

6. An apparatus for refining a sulfidic copper ore concentrate which comprises:

a furnace housing, a smelting cyclone discharging into said furnace housing, a plurality of spaced lances in said housing arranged to blow reducing gases onto the surface of molten metal formed in said smelting cyclone, a water inlet line connected to said smelting cyclone to circulate water therethrough, and a steam exit line for removing steam generated by passage of water through said smelting cyclone.

7. An apparatus according to claim 6 which includes:

discharge means at one end of said housing for discharging molten metal therefrom, and discharge means at the opposite end of said housing for discharging molten slag therefrom.

* * * * *